US006609525B2

(12) United States Patent
Potter et al.

(10) Patent No.: US 6,609,525 B2
(45) Date of Patent: Aug. 26, 2003

(54) HAIR COIL WITH HOLDING PIN

(76) Inventors: Sean Potter, 3525 Del Mar Heights Rd., PMB 586 Del Mar, CA (US) 92130; Erika Potter, 3525 Del Mar Heights Rd., PMB 586 Del Mar, CA (US) 92130; Gustav Tandberg, 3525 Del Mar Heights Rd., PMB 586 Del Mar, CA (US) 92130

( * ) Notice: Subject to any disclaimer, the term of this patent is extended or adjusted under 35 U.S.C. 154(b) by 0 days.

(21) Appl. No.: 09/853,946

(22) Filed: May 14, 2001

(65) Prior Publication Data

US 2002/0166567 A1 Nov. 14, 2002

(51) Int. Cl.[7] ..... A45D 8/06; A45D 8/00
(52) U.S. Cl. ..... 132/280; 132/276
(58) Field of Search ..... 132/280, 281, 132/282, 283, 284, 273, 276, 278

(56) References Cited

U.S. PATENT DOCUMENTS

| | | | | | |
|---|---|---|---|---|---|
| 43,914 | A | * | 8/1864 | Howells | 132/280 |
| 1,434,895 | A | * | 11/1922 | Heussner | 132/280 |
| 2,014,328 | A | * | 9/1935 | Hawkinson | 132/280 |
| 2,598,943 | A | * | 6/1952 | Solomon | 132/280 |
| 5,271,421 | A | * | 12/1993 | Videtzky | 132/200 |
| 5,458,109 | A | * | 10/1995 | Tu | 132/279 |
| 5,682,908 | A | * | 11/1997 | Chou | 132/278 |

* cited by examiner

*Primary Examiner*—John J. Wilson
*Assistant Examiner*—Robyn Kien Doan
(74) *Attorney, Agent, or Firm*—Steven W. Webb

(57) ABSTRACT

An improved hair-restraint device is presented, shaped as an elongated helix and possessing a detachable pin that can be inserted down the long axis of the helix to hold hair in place. The device can be made of rigid, semi-rigid, or flexible material that will hold the helical shape.

4 Claims, 1 Drawing Sheet

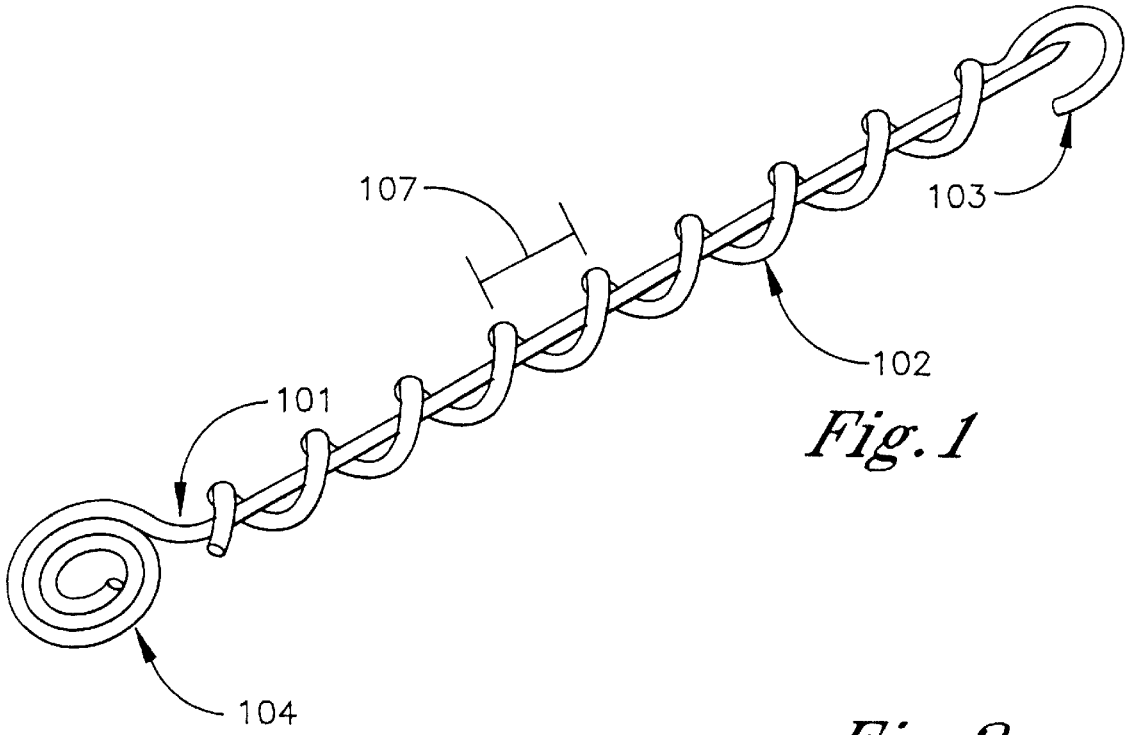
Fig. 1
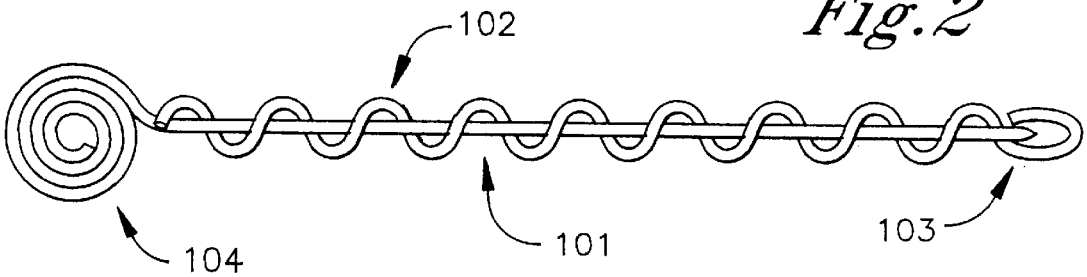
Fig. 2
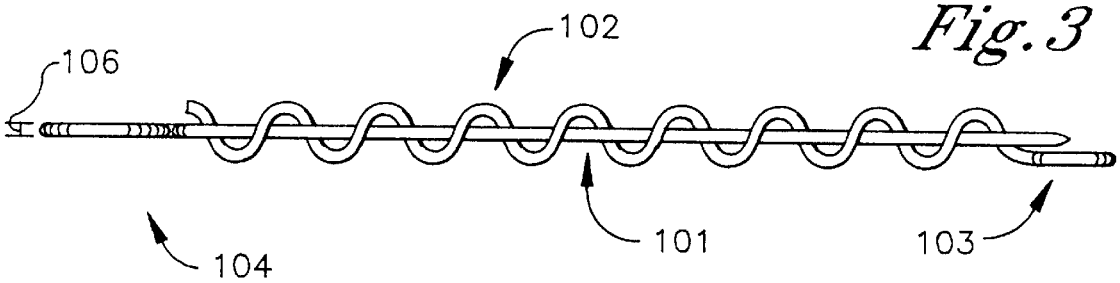
Fig. 3
Fig. 4
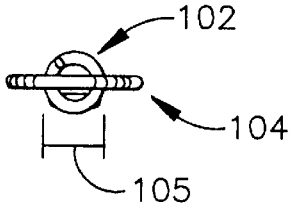
Fig. 5
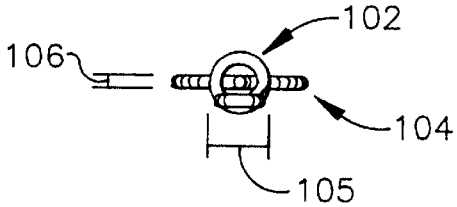

HAIR COIL WITH HOLDING PIN

BACKGROUND OF THE INVENTION

1. Field of the Invention

The present invention relates to hair-restraint devices and devices for decorating, constraining, and shaping hair.

2. Description of Related Art

In the prior art, hair restraint devices have been produced in a variety of shapes and sizes. These run the gamut from flexible devices such as simple hair ribbons, rubber bands, "scrunchies", and the like to barrettes, combs, and other inflexible structures. Previous inventions of this sort include U.S. Pat. No. 5,878,755 which teaches a rigid helical structure without a restraining pin that wraps around bundles of hair and which allows hair to unwind from the device easily.

SUMMARY OF THE INVENTION

The present invention consists of a helical structure made from rigid, semi-rigid, or flexible material with a straight axis down the length of the helix, the pitch of the helix being consistently the same distance the entire length. The invention also possesses a single pin with a decorative end, the decoration not part of this invention. The pin is inserted down the axis of the helical structure and the pin can be of varying thicknesses, depending on the embodiment selected. The pitch distance and the diameter of the helix are not necessarily related to each other.

Unlike other previous inventions (notably U.S. Pat. No. 5,878,755), the presence of the pin inside the helix makes the relationship between the pitch width and the diameter of the helical structure relatively unimportant, because the pin holds the hair to be wound into the invention in place. The pin is a significant improvement in functionality for this type of hair-restraint device.

It is an object of this invention to provide a hair restraint device that is simple to manufacture and has a minimum number of parts.

It is an objective of this invention to provide a hair-restraint device that has decorative features and facilities to attach other decorations.

It is a further object of this invention to provide a hair-restraint device that will accept and hold bundles of hair of any thickness less than the pitch distance.

It is a further objective of this invention to enable this invention to accommodate any pin thickness up to the interior diameter of the helical structure.

BRIEF DESCRIPTION OF THE DRAWINGS

Further objects and features of the present invention are disclosed by the accompanying figures:

FIG. 1 shows the device in perspective view.

FIG. 2 shows the device in top view.

FIG. 3 shows the device in side view.

FIG. 4 shows the device in end view.

FIG. 5 shows the device in end view from the other end.

DETAILED DESCRIPTION OF THE PREFERRED EMBODIMENT

Referring to FIG. 1, the pin 101 is inserted into the long axis of the helical structure 102 which ends in a decorative loop 103. In the preferred embodiment, the shape of the decorative loop 103 is not part of the invention, and the loop can be of any shape that results in a closed loop structure. The helical structure 102 and the decorative loop 103 are a single piece of rigid, semi-rigid, or flexible material. The pin 101 is made of a rigid or semi-rigid material and possesses a decorative end, 104. The decorative end can be of any shape such that it prevents the pin from sliding all the way through the helical structure 102. In the preferred embodiment, the decorative end is a spiral, as shown in the figures.

The inside diameter 105 of the helical structure 102, as shown in FIG. 4 and FIG. 5, is any reasonable size that allows a pin 101 with a smaller pin diameter 106 to be inserted. In the preferred embodiment, the pin diameter 106 is substantially smaller than the interior diameter of the helical structure 105. The pitch width 107 and the inside diameter of the helical structure 105 can be of any size relative to each other that is compatible with restraining bundles of hair, in cooperation with a pin 101 inserted through the helical structure 102.

This invention has other applications, potentially, and one skilled in the art could discover these. The explication of the features of this invention does not limit the claims of this application; other applications developed by those skilled in the art will be included in this invention.

What is claimed is:

1. A hair restraint device that is an elongated helix in shape, said hair restraint device also possessing an elongated pin inserted into the long axis of said elongated helix, said elongated pin also possessing a decorative end, said decorative end shaped in such a manner as to prevent said elongated pin from passing completely through the long axis of said elongated helix, said elongated helix possessing at one end a decorative structure, said decorative structure being a continuation of the body of said elongated helix, said hair restraint device used to enclose strands of hair, said strands of hair enclosed by said hair restraint device by means of winding said strands of hair through said elongated helix, said strands of hair running down the long axis of said elongated helix after being wound into said elongated helix, said strands of hair further constrained by inserting said elongated pin into the long axis of said elongated helix through either end of said elongated helix.

2. A hair restraint device as in claim 1 where said elongated helix is comprised of rigid material and said elongated pin is comprised of rigid material.

3. A hair restraint device as in claim 1 where said elongated helix is comprised of a semi-rigid material.

4. A hair restraint device as on claim 1 where said elongated helix is comprised of flexible material.

* * * * *